US010488160B2

(12) United States Patent
La Scola et al.

(10) Patent No.: US 10,488,160 B2
(45) Date of Patent: Nov. 26, 2019

(54) FIREARMS TARGET

(71) Applicants: Joseph D. La Scola, Toms River, NJ (US); Paul Hetzel, Annapolis, MD (US)

(72) Inventors: Joseph D. La Scola, Toms River, NJ (US); Paul Hetzel, Annapolis, MD (US)

( * ) Notice: Subject to any disclaimer, the term of this patent is extended or adjusted under 35 U.S.C. 154(b) by 0 days.

(21) Appl. No.: 15/829,511

(22) Filed: Dec. 1, 2017

(65) Prior Publication Data

US 2018/0156581 A1 Jun. 7, 2018

Related U.S. Application Data

(60) Provisional application No. 62/429,152, filed on Dec. 2, 2016.

(51) Int. Cl.
*F41J 7/04* (2006.01)
*F41J 1/10* (2006.01)

(52) U.S. Cl.
CPC .. *F41J 7/04* (2013.01); *F41J 1/10* (2013.01)

(58) Field of Classification Search
CPC ..... F41J 7/00; F41J 7/04; F41J 1/10
USPC ..... 273/378–385, 389, 390, 393, 363, 407
See application file for complete search history.

(56) References Cited

U.S. PATENT DOCUMENTS 355,976 A 1/1887 Crandall
402,112 A * 4/1889 Sterick ..... A63F 9/0204 273/393
434,522 A * 8/1890 Pederson ..... F41J 7/04 273/390
1,175,692 A 3/1916 Boicourt
1,413,703 A 4/1922 Biehn
2,259,773 A 10/1940 Papineau
2,535,280 A 12/1950 Gartrell
3,136,440 A 6/1964 Krug et al.
3,280,499 A * 10/1966 Studen ..... A63F 9/10 273/156
3,330,561 A 7/1967 Kandel
3,353,827 A 11/1967 Dun, Jr.
3,392,859 A 7/1968 Fischer
4,066,261 A 1/1978 Stewart
4,076,246 A 2/1978 Meyer
4,121,959 A 10/1978 Meyer
4,243,228 A 1/1981 Marcella
4,245,843 A 1/1981 Griggs
4,332,390 A 6/1982 Bury
4,362,698 A 12/1982 Boosalis et al.
4,935,274 A 6/1990 DeBenedictis et al.
5,197,743 A 3/1993 Hanson, Jr.
(Continued)

OTHER PUBLICATIONS

"Smoke Em' Targets", smokeemtargets.com, http://smokeemtargets.com/, Jan. 27, 2014, (one (1) page).
(Continued)

*Primary Examiner* — Mark S Graham
(74) *Attorney, Agent, or Firm* — Lambert Shortell & Connaughton; Gary E. Lambert; David J. Connaughton, Jr.

(57) ABSTRACT

A target system is provided which allows a user to visually identify from a distance if the intended target has been hit. The target uses a base with at least one target disc held to the base. Upon hitting the target disc with a projectile, the disc is dislodged and, being larger than the projectile, leaves an opening in the base that can be visually identified from a distance.

19 Claims, 5 Drawing Sheets

(56) References Cited

U.S. PATENT DOCUMENTS

| | | | | |
|---|---|---|---|---|
| 5,486,425 | A | 1/1996 | Seibert | |
| 5,647,596 | A * | 7/1997 | Rail | F41J 5/18 273/374 |
| 5,653,124 | A | 8/1997 | Weber | |
| 6,277,331 | B1 | 8/2001 | Konrad | |
| 6,926,624 | B1 | 8/2005 | Witzke | |
| 6,966,557 | B2 | 11/2005 | Kirk et al. | |
| 8,109,845 | B2 | 2/2012 | Duty | |
| 9,713,776 | B1 * | 7/2017 | Leung | A63H 33/006 |
| 2002/0163131 | A1 * | 11/2002 | Yiu | F41J 5/052 273/374 |
| 2005/0082290 | A1 | 4/2005 | Fask et al. | |
| 2008/0185787 | A1 * | 8/2008 | Hinnant | F41J 1/01 273/407 |
| 2008/0214331 | A1 | 9/2008 | Talafous et al. | |
| 2011/0316234 | A1 | 12/2011 | Miller, Sr. | |
| 2013/0009364 | A1 | 1/2013 | Forness et al. | |
| 2013/0038020 | A1 | 2/2013 | Davis, Jr. | |
| 2013/0228974 | A1 | 9/2013 | Davis, Jr. | |

OTHER PUBLICATIONS

"New ideas for reactive target shooting" www.youtube.com, http://www.youtube.com/watch?v=FgFGIpGv4nk, Jan. 27, 2014, (two (2) pages).

"Good Times with Ghost Targets" girlsguidetoguns.com, http://girlsguidetoguns.com/2012/10/29/good-times-with-ghost-targets/, Jan. 27, 2014, (ten (10) pages).

"Double-Duty ReVersa Targets Hold Clay Pigeons on Reverse Side" bulletin.accurateshooter.com, http://bulletin.accurateshooter.com/2012/11/32196, Jan. 27, 2014, (three (3) pages).

"Firebird Reactive Targets" http://woodlandsltd.myshopify.com, http://woodlandsltd.myshopify.com/products/air-rifie-targets-firebird-reactive-targets, Jan. 27, 2014, (two (2) pages).

"Franklin Sports NHL 'Knock-Out' Shooting Targets" Overstock.com—https://www.overstock.com/Sports-Toys/Franklin-Sports-NHL-Knock-Out-Shooting-Targets/10518121 /product.html, Nov. 27, 2017 (five (5) pages).

"Knockout Foam Targets" Merlin Archery Ltd., http://www.merlinarchery.co.uk/larp-foam-targets.html, Nov. 27, 2017 (four (4) pages).

* cited by examiner

FIREARMS TARGET

BACKGROUND OF THE INVENTION

Field of the Invention

The present invention relates generally to a firearms target. More particularly the present invention relates to a firearms target that provides a dislodging "pop-out" action allowing visual confirmation of a target hit from a distance.

Description of Related Art

Shooters at indoor ranges are traditionally restricted to shooting primarily paper product targets which do not provide much feedback when the target is struck. The current most visual feedback provided for indoor targets are chip-away paint type products which leave a different color mark or bullet-sized hole to show a bullet strike. Shooters in ranges all over the world clip a paper target onto a trolley and press a button that carries the target to the desired distance. The shooter fires his/her shots at the target and then brings the target back to get feedback on where the bullets hit the target. Once the paper targets are hit repeatedly with several shots, it is very difficult to determine which holes are from which shots, and the slightly used paper targets are discarded into the trash. Such paper targets are expensive hand have very limited usefulness before having to be replaced.

Indoor shooting ranges use what is known as a "trolley system." This trolley system is a motorized cable or chain mechanism mounted from the ceiling of an indoor shooting range that can remotely move a hanging target clip away from or closer to the firing line where the shooter is positioned. The shooter controls trolley movement by a switch. This allows shooters to remain safely behind the firing line. While very safe and useful, the trolley often can carry the target far enough away from a shooter that the strikes on the target are difficult or impossible to identify.

Therefore, what is needed is a firearms target that may provide visual indication from a distance that the target was hit, which may be used in any firing range including indoor and outdoor firing ranges.

SUMMARY OF THE INVENTION

The subject matter of this application may involve, in some cases, interrelated products, alternative solutions to a particular problem, and/or a plurality of different uses of a single system or article.

In one aspect, a target is provided. The target is formed of a base and a target disc frictionally connected to the base by being partially passed through an aperture of the base. The target disc has a protrusion extending from its outer side, which may engage with the base at a perimeter of the aperture formed by the base. A tether extends between the base and the target disc, and is connected to each.

In another aspect, a target is provided. The target has a base which defines an aperture through its surface. A target disc is frictionally connected to the base by being passed through this aperture. The target disc has a tapered rib extending from a lengthwise surface of the target disc, with a portion of the tapered rib abutting the base edge at the aperture. A tether extends between the base and the target disc, and is connected to each.

In an embodiment of operation, a user may fire a projectile at the target disc, and upon hitting the target disc by the projectile, the target disc is dislodged but remains connected to the base by the tether.

DETAILED DESCRIPTION

Figures 1A, 1B, 1C:
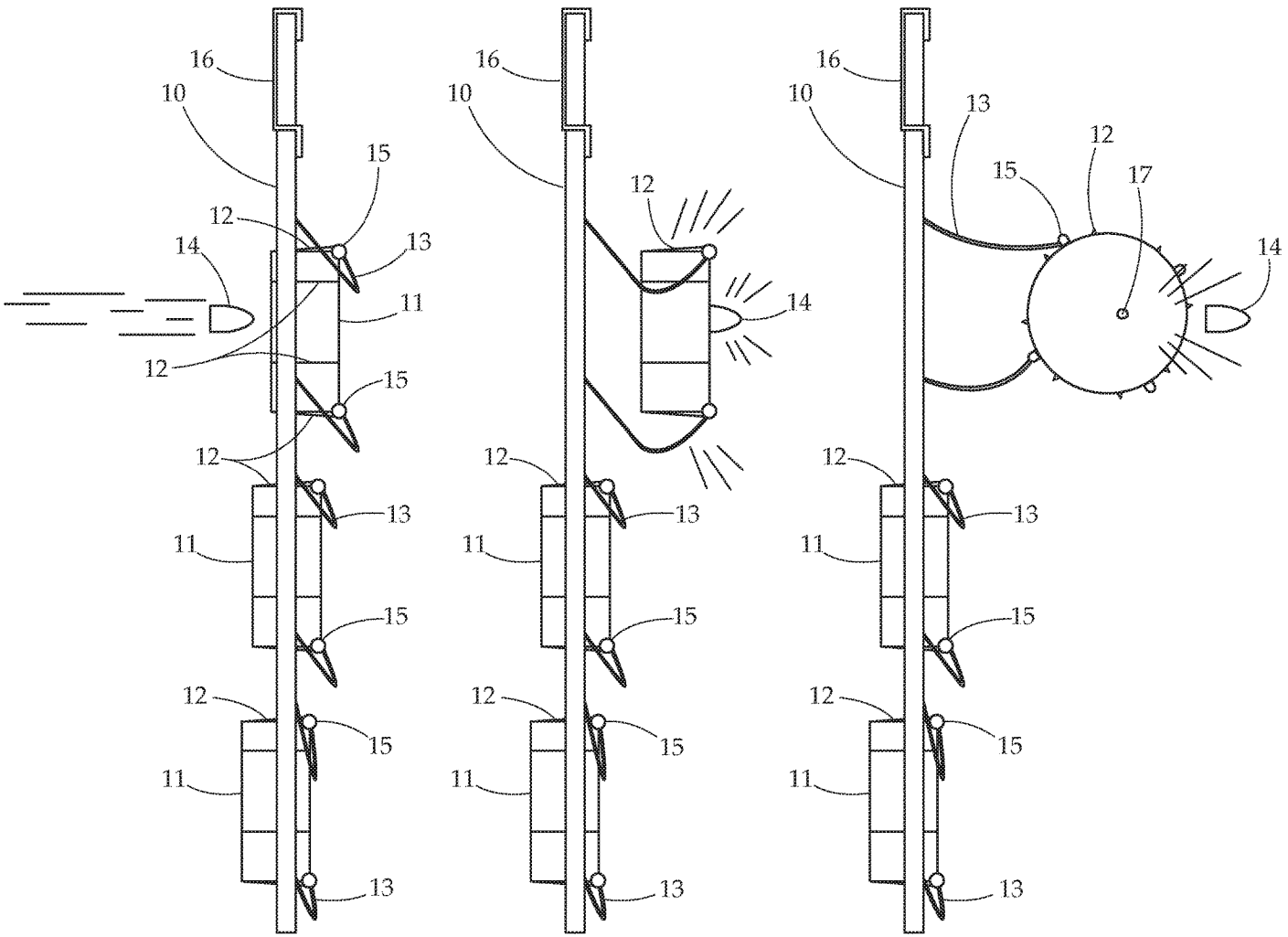
FIG. 1A provides a side view of an embodiment of the present invention.
FIG. 1B provides a side view of an embodiment of the present invention.
FIG. 1C provides a side view of an embodiment of the present invention.
Figure 1E:
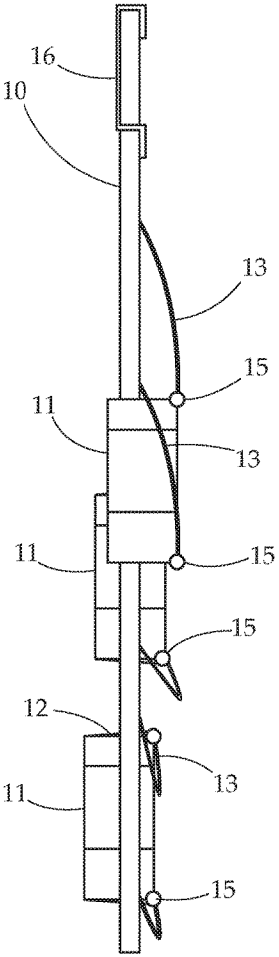
FIG. 1E provides a side view of an embodiment of the present invention.

The detailed description set forth below in connection with the appended drawings is intended as a description of presently preferred embodiments of the invention and does not represent the only forms in which the present invention may be constructed and/or utilized. The description sets forth the functions and the sequence of steps for constructing and operating the invention in connection with the illustrated embodiments.

Generally, the present invention concerns a firearms target which provides a "pop-out" effect when a target disc is struck by a projectile. The target is formed of a base which defines at least one aperture in which a target disc may be held. At least part of the disc contacts the base at an edge of the aperture. Upon contact by a projectile, the target disc allows the projectile to fully pass through its surface, while at the same time being impacted enough by the projectile to be dislodged from the aperture to fall out from the base. This leaves a relatively large opening in the base, which a shooter can see from a distance. In one embodiment, the disc is held to the base by at least one tether, which prevents the disc from falling away from the target. In some embodiments, such as with the use of the target on an indoor shooting range, it is important to keep the target disc connected to the target base by the tether, so that the target discs do not fall to the ground at the indoor shooting range. The present invention overcomes shortcomings in the prior art, providing an enjoyable, reusable, and rewarding shooting experience. In some embodiments, the target may be reusable for between 200-500 rounds, depending on caliber.

The firearms target of the present invention utilizes target discs which are capable of both allowing a projectile to pass through, but also capable of being dislodged from the target by the force of the projectile. Prior art foam or other target materials may be too soft or too firmly held in place to allow this. For example, in most embodiments, the disc of the present invention may be configured to be dislodged from its connection to the target base by a bullet or other projectile travelling at 900-2000 FPS, such as a 30 gram projectile travelling at 1000 FPS. Many prior art targets not designed for projectile use would simply allow the bullet to pass right through without reacting.

The base may be any size and shape, and may be formed of any material capable of supporting the discs. Examples of which the base may be made include, but are not limited to, cardboard, paper, plastics, foam, fabrics, and the like. In a particular embodiment, the base may be made of one material, with a different reinforcing material about the aperture in which the disc fits.

The target disc may any size and shape and may be formed of any material capable of being held in the aperture of the base by engaging with the base. Generally, the disc is cylindrical in shape, matching circular apertures in the base. This cylindrical shape is not required however, and other shapes may be used for the disc and its corresponding base aperture. In most embodiments, the disc is intended to allow a projectile to pass through it. In one embodiment, the disc may be formed of a plastic material. Thickness of the projectile-receiving face may vary depending on embodiment, and material used. In one embodiment, the projectile receiving face may have a thickness of approximately 1/16". However this thickness may of course vary. In such an embodiment, the lengthwise sides of the disc may extend beyond the rear of the projectile receiving face, making the disc longer than the projectile receiving face is thick. In a particular embodiment, the disc may be formed of a material that may partially "self heal" in that once impacted by the projectile, which passes through the disc, the hole formed by the projectile may at least partially close up. Typically soft and/or resilient plastics such as low density polyethylene (LDPE) is effective for self healing, although it is understood that many different materials may have this function.

The projectile contemplated herein may be any projectile directed to a target. In many embodiments, the projectile is fired from a firearm, such as a bullet, BB, pellet, airsoft projectiles, Nerf® projectiles, paintball, and the like.

One, and in many embodiments two, tether(s) may connect the disc to the base. The tether may be any elongate material capable of holding the disc to the base once it has been dislodged from the base by a projectile. In a particular embodiment, the tether may have elastic properties to allow it to absorb force as the disc is reacting to being impacted by a fired projectile. In one embodiment, two tethers may be desirable because if one tether fails, the other will hold it to the base. In indoor ranges, targets must not drop material from the target to the base, and the backup tether helps to ensure that the disc does not drop to the ground. In one embodiment, the tether or tethers may be positioned closer to an edge of the base that the disc is closest to than the disc, so that upon forceful impact, the disc will swing outward from the base and around its outer edge.

In many embodiments, it is desirable that the disc can be held in place to the base and separated from the base upon impact of a fired projectile. Depending on the type of projectile being fired, the amount of force applied from the projectile to the disc may vary. For example, a BB or pellet gun's projectiles will apply less force to the disc to dislodge it than a larger or more powerful projectile. Therefore, in many embodiments it is desirable that the disc be connectable to the device in a way that can vary the amount of force required to disconnect it. In operation, the target discs must be capable of being held in place by the connection to the aperture when the target is struck by a projectile, such that the resultant vibrational or other impact forces don't dislodge it unless it is struck by a projectile directly. Moreover, temperature will slightly modify the size of the apertures in which the disc may fit to the base. Therefore, the disc must be able to connect to the base when the base is cold or warm as the aperture size changes.

In one embodiment to solve these problems, the disc of the present invention has a tapering or otherwise variable width/diameter along its length, being wide at its rear and narrow at its front. This allows the disc to be gently held in place when only slightly pushed into the base, or tightly held in place when forced further into the base. In a particular embodiment, the disc may have one or more tapering ribs along its outer lengthwise surface. In a further embodiment, the one or more tapering ribs may have one or a plurality of nubs protruding from the outside of the rib, allowing a graduated connection to the base. Typically this connection will be frictional, but other alternative connections are not excluded by the present invention.

The base may be connectable to a trolley of an indoor shooting range or other support. Trolleys typically use clips or similar connectors to hold targets in place. To engage with such a clip, in one embodiment, the base of the present invention may have a connector area, which is spaced apart slightly from a rear of the base to allow a clip to connect thereto.

Turning now to FIGS. 1A-1E, a side view of a series of conditions of operation of the present invention are shown. A base 10 holds three target discs 11 which are passed partially through apertures in the base 10 and have at least part of the disc 11 contacting the base 10 at an edge of the aperture. At least part of the disc contacts the base at an edge of the aperture. These discs 11 can be seen to be at different positions in the base, indicating different levels of securement. As the disc 11 is pushed further into the aperture formed by the base, the tension between disc 11 and base 10 increases. A tapering rib 12 on the lengthwise surface of the target disc 11 makes the disc 11 narrower at its front and wider at its rear. The top disc 11 is least inserted into the base 10, meaning that it is the most gently held in place. It's positioning is at a "light" setting and it may be dislodged easily. The middle disc 11 is at a middle point in the aperture of the base, making it harder to dislodge than the top disc 11. The bottom disc 11 is the furthest inserted into the base 10, which is the most secure setting, used for high caliber projectiles. Tethers 13 hold each disc 11 to the base 10. Two retainer tabs 15 hold the tethers to the disc 11. Retainer tabs 15, in some embodiments, also act to prevent the target disc 11 from being completely pushed through the aperture of the base 10. An upper portion 16 of the base 10 is configured as a connection area to be clipped to a trolley or other support.

Figure 1D:
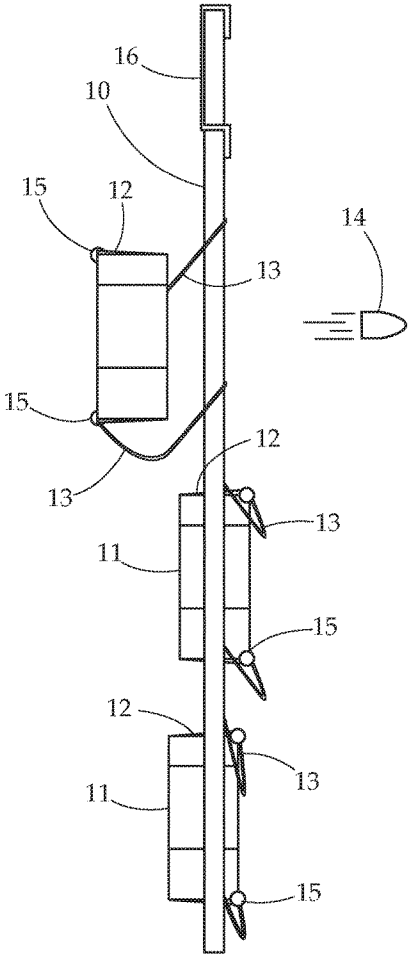
FIG. 1D provides a side view of an embodiment of the present invention.

The result of a projectile impact to disc 11 is shown by the series of figures in FIGS. 1A-1E. Initially, in FIG. 1A all of the discs 11 are in place on the base 10. A projectile 14 is incoming and will impact the top disc 11. In FIG. 1B the projectile has hit and passed through disc 11, and in the process has dislodged the disc 11. In FIG. 1C, because the tethers 13 in this embodiment are connected to the base 10 closer to an edge of the base 10 than the disc 11, the disc 11 swings outward from the base 10 and past a front of the base 10 (FIG. 1D). The hole 17 from the projectile can be seen in the disc 11. In this embodiment, the hole 17 has closed slightly from the size of the projectile 14 due to the material properties of the disc 11. Finally, the disc 11 is at rest in FIG. 1E, leaving a large opening (not shown) in the base 10 which is easily visible to the shooter from a distance. The additional action and movement of the disc 11, such as its rapid movement away from the side of the base 10, is also visible to the shooter. This action gives the shooter an exciting, rewarding feedback of a "hit", ensuring that it is clear that the target disc 10 has been hit.

Figure 2:
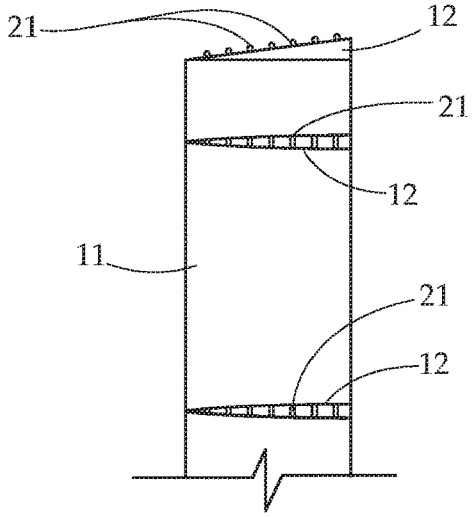
FIG. 2 provides a detail side view of a target disc of the present invention.

FIG. 2 provides a detail view of an embodiment of the target disc 11 having a tapered rib 12 along its lengthwise surface. In this view, the disc edge 10 can be seen to have the tapered rib 12 extending therefrom, such that the front of the disc 11 is narrower than the rear of the disc 11. In the embodiment shown, the rib 12 further comprises a plurality of protruding nubs 22 which act to provide extra tension in the connection between the disc 11 and base 10 through the base aperture, and also act to provide graded points that the disc 11 can connect to the base 10 through the aperture.

Figure 3:
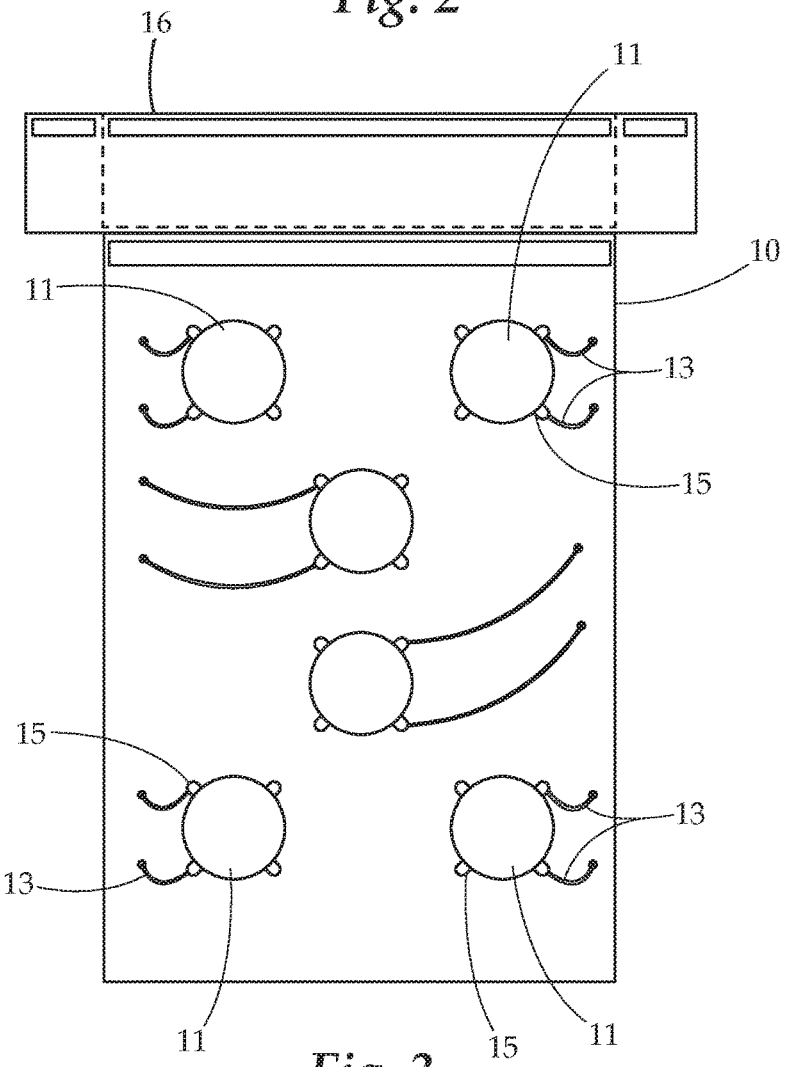
FIG. 3 provides a rear view of yet another embodiment of the preset invention.

FIG. 3 shows a rear view of an embodiment of the present invention. In this view, the base 10 defines six apertures and there are six discs held to the base 10. One disc 10 in each aperture. Two tethers 13 connect each disc 11 to the base 10 by a retainer tab 15 on the disc 11. The connector 16 may be an additional strip of, for example, cardboard, or in another embodiment may be a strip that is spaced back slightly from the base 10, or may be an upper part of the base 10, among other configurations. It is notable that in this embodiment, the tethers 13 are each closer to an edge of the base 10 than the discs 11. This causes the discs 11 to be urged outwardly away from the base edge 10 when struck by a projectile.

Figure 4:
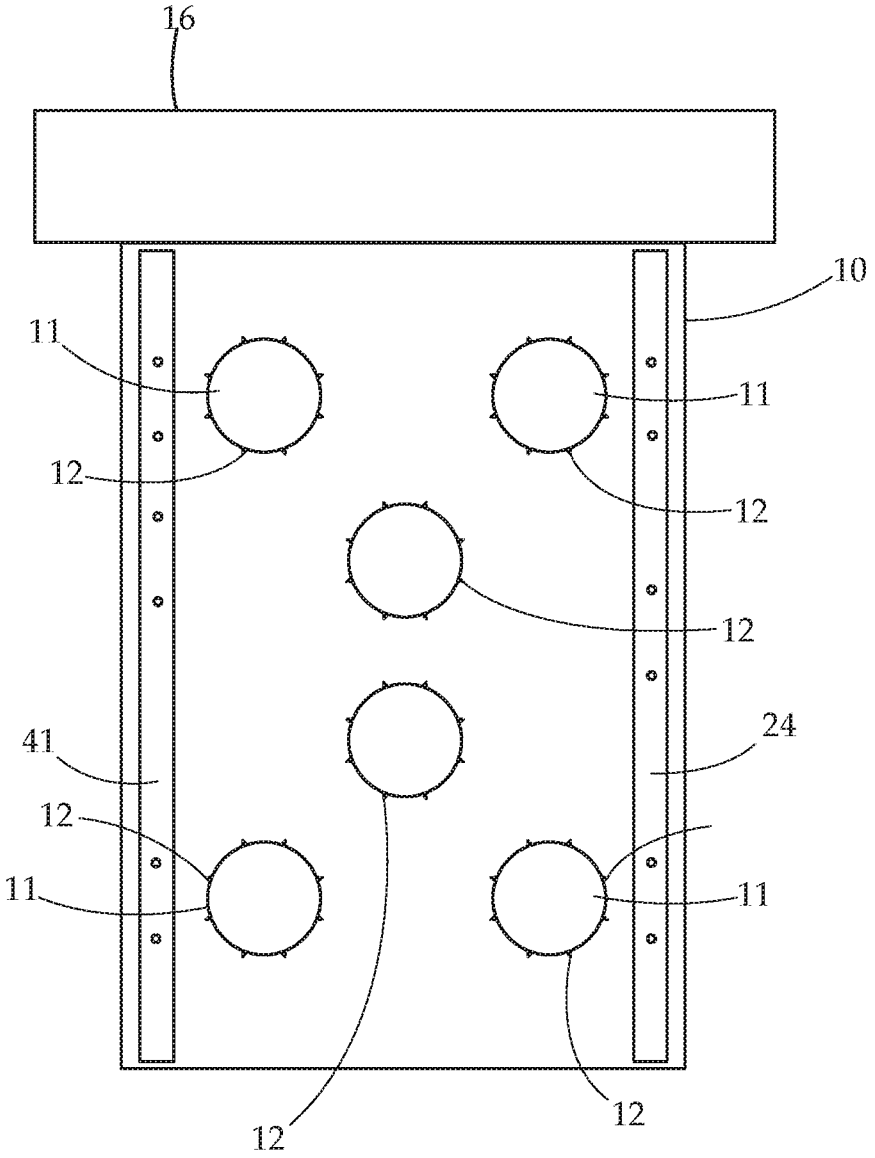
FIG. 4 provides a front view of still yet another embodiment of the present invention.

FIG. 4 provides a front view of an embodiment of the present invention. In this view, the base 10 defines six apertures with a disc 11 passing through each. The tether ends 24 are passed through the base 10, and also passed through a plastic reinforcement layer 41. The reinforcement layer 41 helps to both firmly anchor the tether ends 24 and to reinforce the edges of the base 10.

Figure 5:
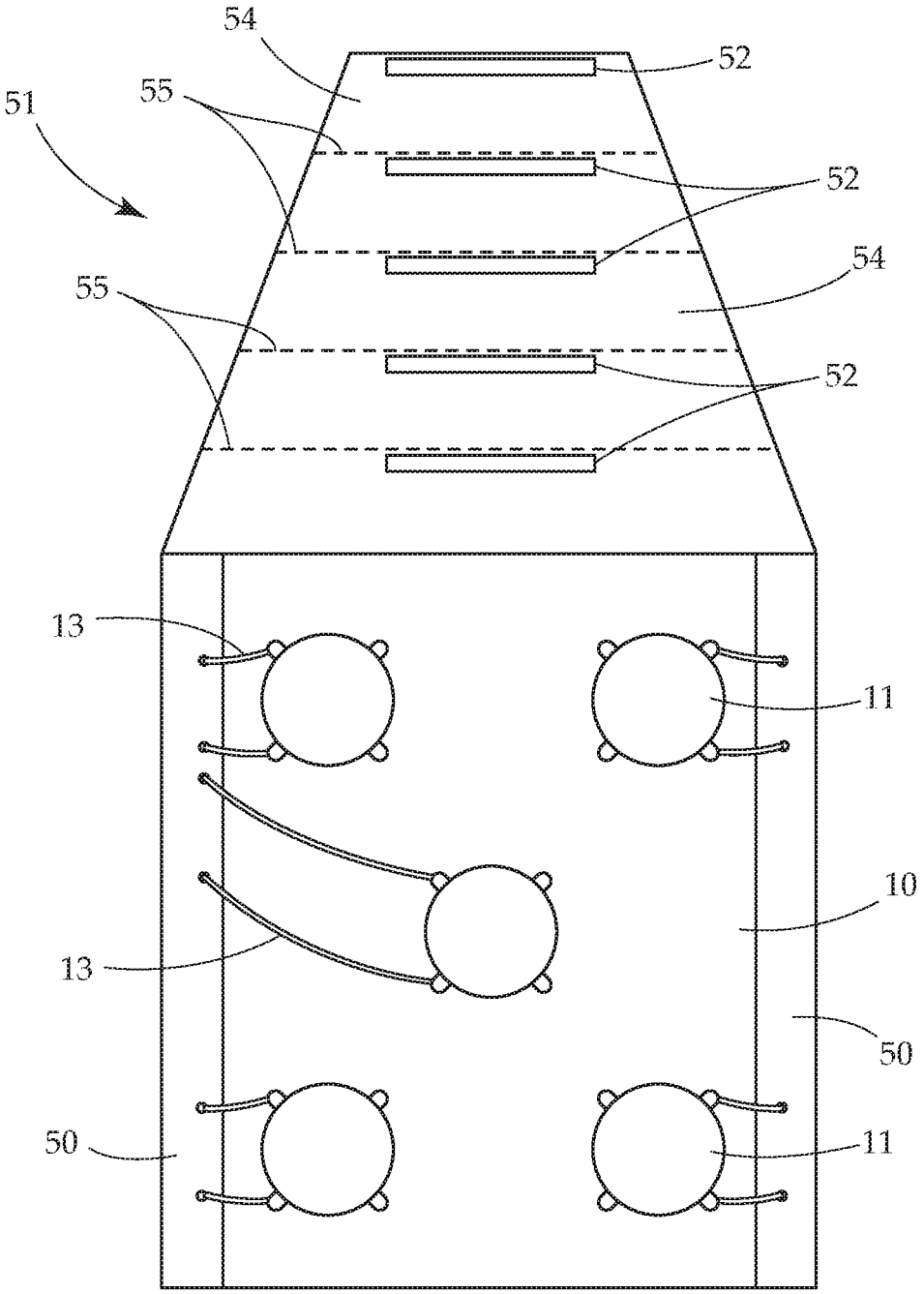
FIG. 5 provides a view of another embodiment of the present invention.

FIG. 5 provides a rear view of another embodiment of the present invention. In this view, a fold or additional layer 50 reinforces the rear edges of the base 10. Further, this embodiment utilizes a variable connector 51 formed as a folding header. The connector 51 lowers the backer from the clamp apparatus that it can connect to, protecting the clip from off target shots. This header/connector 51 has fold out tabs on its side that allow the target to be hung or attached to different clamp widths. This connector 51 may be removed entirely if the target is to be used in other conditions such as outdoor or if mounted by its sides. A plurality of connector levels 54 have a connector pad or plate 52. Each level 54 is separated by perforations 55 which allow the variable connector 51 to be folded or torn to adjust the height of the base 10 relative to its connection point.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

What is claimed is:

1. A target comprising:

a base, the base defining an aperture through its surface;

a target disc frictionally connected to the base by passing partially through the aperture;

a tapered rib extending from a lengthwise surface of the target disc, a portion of the tapered rib abutting the base edge at the aperture;

a tether connected to the base and the target disc.

2. The target of claim 1 further comprising a plurality of tapered ribs positioned about the lengthwise surface of the target disc.

3. The target of claim 1 wherein the tapered rib comprises a plurality of protruding nubs protruding from an edge of the tapered rib.

4. The target of claim 1 further comprising two tethers connected to the disc and the base.

5. The target of claim 1 wherein the tether is connected to the base at a point that is closer to an edge of the base than the aperture is.

6. The target of claim 1 further comprising a plurality of apertures and a plurality of target discs, each of the plurality of discs frictionally connected to the base by passing partially through one of the plurality of apertures.

7. The target of claim 1 further comprising a plurality of tapered ribs positioned about the lengthwise surface of the target disc, and wherein each of the plurality of tapered ribs comprises a plurality of protruding nubs, which protrude from an edge of the tapered rib.

8. The target of claim 1 wherein the base further comprises a plastic reinforcement, the tether connected to the base by connecting to the plastic reinforcement.

9. The target of claim 1 wherein the target disc is formed of low density polyethylene.

10. The target of claim 1 wherein the base further comprises a connector configured to be held by a clip.

11. The target of claim 1 wherein the tether is connected to the target disc by a retainer tab which extends outward from a widthwise edge of the target disc.

12. The target of claim 1 wherein the disc is connectable to the base in a first position slightly passing through the aperture, a second position approximately halfway into the aperture by length, and a third position almost fully passing through the aperture, wherein in the third position, the disc is more tightly held in place than when in the second position, and wherein the disc in the second position is more tightly held in place than when in the first position.

13. The target of claim 1 wherein the target disc is formed having a thickness allowing a projectile to fully pass through an impact face.

14. The target of claim 1 wherein the tether is elastic.

15. A target comprising:

a base, the base defining an aperture through its surface;

a target disc frictionally connected to the base by passing partially through the aperture;

a protrusion formed on an outer lengthwise surface of the target disc;

a tether connected to the base and the target disc;

wherein the target disc is operable to be dislodged from the base when struck by a projectile, the dislodged target disc being the only indication of the projectile hitting the target disc.

16. The target of claim 15 further comprising a plurality of protrusions positioned about the lengthwise surface of the target disc.

17. The target of claim 15 wherein the protrusion comprises a plurality of nubs, which extend from an edge of the protrusion.

18. The target of claim 15 wherein the target disc is formed having a thickness allowing a projectile to fully pass through an impact face.

19. The target of claim 15 wherein the base is attached to a support of an indoor firing range.

* * * * *